US005419294A

United States Patent [19]

Dingle

[11] Patent Number: 5,419,294

[45] Date of Patent: May 30, 1995

[54] LOAD COMPENSATING FUEL SYSTEM

[75] Inventor: Philip J. G. Dingle, Rochester, Mich.

[73] Assignee: Lucas Industries public limited company, England

[21] Appl. No.: 78,182

[22] PCT Filed: Sep. 16, 1991

[86] PCT No.: PCT/GB91/01581

§ 371 Date: Oct. 15, 1993

§ 102(e) Date: Oct. 15, 1993

[87] PCT Pub. No.: WO92/06288

PCT Pub. Date: Apr. 16, 1992

[30] Foreign Application Priority Data

Sep. 28, 1990 [GB] United Kingdom ..... 9021224

[51] Int. Cl.[6] ..... F02D 41/04

[52] U.S. Cl. ..... 123/399; 123/357

[58] Field of Search ..... 123/357, 399, 494, 488, 123/396

[56] References Cited

U.S. PATENT DOCUMENTS

| | | | |
|---|---|---|---|
| 3,908,614 | 9/1975 | Ironside et al. | 123/494 |
| 4,198,934 | 4/1980 | Carp et al. | 123/488 |
| 4,682,044 | 7/1987 | Hotate et al. | 290/40 B |
| 4,762,108 | 8/1988 | de Concini | 123/494 |
| 4,977,880 | 12/1990 | Bonfiglioli et al. | 123/488 |
| 5,062,294 | 11/1991 | Iwata | 73/115 |

FOREIGN PATENT DOCUMENTS

| | | |
|---|---|---|
| 0327130 | 8/1989 | European Pat. Off. . |
| 3905824 | 11/1989 | Germany . |
| 11643 | 6/1985 | Japan . |
| 306250 | 4/1989 | Japan . |

*Primary Examiner*—Henry C. Yuen
*Assistant Examiner*—Thomas N. Moulis
*Attorney, Agent, or Firm*—Andrus, Sceales, Starke & Sawall

[57] ABSTRACT

A fuel system for an engine (10) has a transducer (16) which supplies an input signal to an electronic fuel control system (15) representing driven demand. A variable gain amplifier (19) modifies the signal applied to the control system and is controlled by a load sensor (20) which detects when a suddenly applied load is placed on the engine such as when an air conditioning compressor (18) is brought into operation or when the power output of the alternator (17) is suddenly increased.

4 Claims, 1 Drawing Sheet

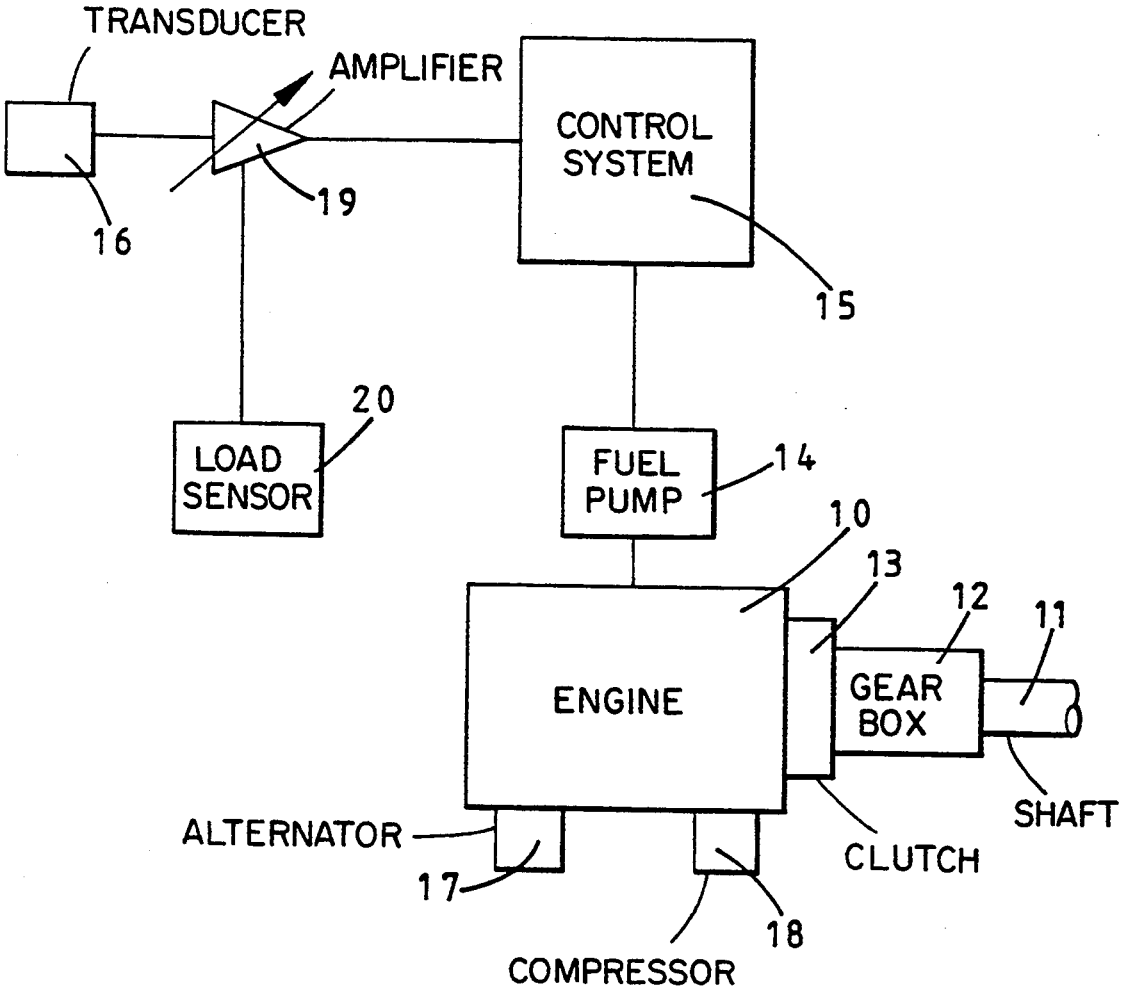
TRANSDUCER
AMPLIFIER
CONTROL SYSTEM
16
19
15
20
LOAD SENSOR
FUEL PUMP
14
10
13
12
11
ENGINE
GEAR BOX
SHAFT
ALTERNATOR
CLUTCH
17
18
COMPRESSOR

LOAD COMPENSATING FUEL SYSTEM

BACKGROUND OF THE INVENTION

This invention relates to a fuel system for a vehicle internal combustion engine and of the kind in which an operator controlled electrical signal is utilised as an input signal to the fuel system to determine the rate of fuel supply by the fuel system to the associated engine.

In such a fuel system for a compression ignition engine there may be provided a high pressure fuel pump having a quantity control member which may for example be a rack bar or an angularly adjustable throttle member, the position of which is determined by an electromagnetic actuator. The supply of electrical power to the actuator is controlled by an electronic control system in response to said signal. The quantity control member may also be in the form of an electromagnetically operable valve controlled by the control system. In the case of a spark ignition engine the usual butterfly valve may be positioned by means of an electromagnetic actuator with the supply of power to the actuator being controlled by said signal.

In the use of the vehicle the driver becomes used to the performance of the vehicle and the response of the vehicle to changes in the position of the throttle pedal. Clearly if an additional load is imposed on the vehicle such for example as an additional passenger or some additional cargo, the driver will expect the performance of the vehicle to be diminished. However, in the normal use of the vehicle additional loads such as a heavy electrical load or an air conditioning compressor may be applied to the engine unexpectedly and the apparent performance of the vehicle impaired when the load is applied or enhanced when the load is removed. Such an event will require corrective action on the part of the driver to maintain the desired vehicle speed or rate of acceleration.

SUMMARY OF THE INVENTION

The object of the present invention is to provide a fuel system of the kind specified in a simple and convenient form.

According to the invention a fuel system of the kind specified includes a variable gain amplifier to which said input signal is supplied, and means responsive in use to a suddenly applied load to modify the gain of said amplifier whereby for a given value of said input signal the rate of fuel supplied to the engine will be increased to compensate for the suddenly applied load and vice versa.

BRIEF DESCRIPTION OF THE DRAWING

An example of a system in accordance with the invention will now be described with reference to the accompanying block diagram.

DESCRIPTION OF THE PREFERRED EMBODIMENT

Referring to the diagram there is indicated a compression ignition engine 10 which is coupled to a vehicle transmission shaft 11 through the usual gear box 12 and clutch 13. Fuel is supplied to the engine by means of a fuel system 14 which may comprise a distributor type of fuel injection pump which supplies fuel to the injection nozzles of the engine in timed relationship therewith. The fuel pump includes an angularly adjustable throttle member the position of which is determined by an electro magnetic actuator the supply of power to which is effected by an electronic control system 15. The control system is responsive to various engine operating parameters such for example as the engine speed and it is also responsive to an electrical input signal which is derived from a transducer 16 associated with the throttle pedal of the vehicle.

In use, the signal provided by the transducer 16 represents a demand signal and the electronic control system 15 will control the supply of fuel to the engine 10 to ensure that so far as possible, the output power of the engine varies in response to the setting of the throttle pedal. It will be understood however particularly with the compression ignition engine, that certain engine operating parameters cannot be exceeded for example the maximum engine speed and the level of smoke in the engine exhaust.

The engine drives an alternator 17 and a compressor 18 for the vehicle air conditioning system, the compressor is being coupled to the engine by means of a clutch which can be engaged as and when required. The alternator and the compressor can impose a substantial load on the engine which effectively means that less power will be available to propel the vehicle. The additional loads imposed by the alternator and the compressor will occur unexpectedly with the result that the driver of the vehicle has to alter the position of the throttle pedal to maintain the desired vehicle speed or rate of acceleration.

In order to overcome the problem it is proposed to provide a variable gain amplifier 19 between the transducer 16 and the control system 15. The input of the amplifier is connected to the transducer and the output to the control system. The gain of the amplifier can be adjusted by a load sensor 20. The load sensor may comprise an electric switch which is closed when the compressor 18 is brought into operation and when closed the gain of the amplifier 19 is increased so that for a given throttle setting, the demanded input signal to the control system 15 is increased. This has the effect of causing an increase in the quantity of fuel which is supplied to the engine so that the engine delivers an increased power to compensate for the power absorbed by the compressor. The load sensor may also be responsive to the current delivered by the alternator to again increase the gain of the amplifier 19 when the power output of the alternator is increased.

In the manner described above the driver of the vehicle will be largely unaware of the additional power developed by the engine as a result of the additional loads. Similarly when the loads are removed, the fuel supply to the engine will be reduced. It will be appreciated of course that if the engine is being operated at its full power rating then when the additional loads are placed on the engine the fuel system will be unable to increase the power developed by the engine and in this situation the driver will of course notice the additional load.

I claim:

1. A fuel system for a vehicle internal combustion engine (10) and of the kind in which an operator controlled electrical signal is utilized as an input signal to the fuel system to determine the rate of fuel supply by the fuel system to the associated engine characterised by a variable gain amplifier (19) to which said input signal is supplied and a load sensor (20) responsive in use to a suddenly varied load to modify the gain of said amplifier whereby for a given value of said input signal the rate of fuel supplied by the fuel system to the engine will be varied to compensate for the suddenly varied load.

2. A fuel system according to claim 1, characterised in that said load sensor (20) is responsive to the power output of an alternator (17) driven by the engine.

3. A fuel system according to claim 1, characterised in that the load sensor is responsive to the operation of a compressor (18) of the vehicle air conditioning system.

4. A fuel system according to claim 1, characterised in that said input signal is provided by a transducer (16) associated with the throttle pedal of the vehicle.

* * * * *